US007021088B2

(12) United States Patent
Hong et al.

(10) Patent No.: US 7,021,088 B2
(45) Date of Patent: Apr. 4, 2006

(54) COMBINATION DRIER AND WASHER AND AERATION APPARATUS THEREOF

(75) Inventors: Kyung-Seop Hong, Incheon (KR); Young-Hwan Park, Gwangmyeong (KR); Choon-Myun Chung, Gwangmyeong (KR)

(73) Assignee: LG Electronics Inc., Seoul (KR)

( * ) Notice: Subject to any disclaimer, the term of this patent is extended or adjusted under 35 U.S.C. 154(b) by 557 days.

(21) Appl. No.: 10/251,770

(22) Filed: Sep. 23, 2002

(65) Prior Publication Data

US 2003/0200773 A1 Oct. 30, 2003

(30) Foreign Application Priority Data

Apr. 24, 2002 (KR) ..... 2002-22542

(51) Int. Cl.
*D06F 29/00* (2006.01)

(52) U.S. Cl. ..... 68/20; 34/77

(58) Field of Classification Search ..... 68/19, 68/19.2, 20; 34/73, 75, 77
See application file for complete search history.

(56) References Cited

U.S. PATENT DOCUMENTS

| | | | | |
|---|---|---|---|---|
| 3,121,000 A | | 2/1964 | Hubbard | 34/75 |
| 3,866,333 A | * | 2/1975 | Sarukahanian et al. | 34/75 |
| 4,112,590 A | | 9/1978 | Muller | 34/75 |
| 4,154,003 A | * | 5/1979 | Muller | 34/469 |
| 4,530,170 A | | 7/1985 | Green | 34/82 |
| 4,903,508 A | * | 2/1990 | Durazzani et al. | 68/4 |
| 5,146,693 A | * | 9/1992 | Dottor et al. | 34/77 |
| 5,983,520 A | * | 11/1999 | Kim et al. | 34/261 |
| 6,282,928 B1 | * | 9/2001 | Fukumoto et al. | 68/20 |
| 6,722,165 B1 | * | 4/2004 | Woo et al. | 68/19.2 |
| 2001/0015082 A1 | * | 8/2001 | Minayoshi et al. | 68/19.2 |

FOREIGN PATENT DOCUMENTS

| | | |
|---|---|---|
| DE | 4436673 | 4/1996 |
| GB | 2181220 A | 4/1987 |
| GB | 2181221 A | 4/1987 |
| JP | 8332167 A | 12/1996 |

* cited by examiner

*Primary Examiner*—Joseph L. Perrin
(74) *Attorney, Agent, or Firm*—Fleshner & Kim LLP

(57) ABSTRACT

An aeration apparatus for a combination drier and washer comprises an air circulation duct connected from one portion of a tub to the other portion for circulating air in the tub; an aeration tube connected from the air circulation duct to outside of the case for introducing exterior air; and an opening/closing unit provided at a spot where the air circulation duct and the aeration tube meet for opening and closing the aeration tube, wherein the air circulation duct is connected to a condensing water supply tube for supplying condensing water to condense water in air, and the opening/closing unit is constructed to open and close the aeration tube by condensing water supplied by the condensing water supply tube. During drying, the drying space is closed to improve drying efficiency. Afterward, air is introduced to prevent accidents.

16 Claims, 4 Drawing Sheets

COMBINATION DRIER AND WASHER AND AERATION APPARATUS THEREOF

BACKGROUND OF THE INVENTION

1. Field of the Invention

The present invention relates to a combination drier and washer which washes and dries laundry, and particularly, to a combination drier and washer and an aeration apparatus thereof in which a dry space is closed in a dry processing and exterior air is introduced in a drum when the dry processing is finished.

2. Description of the Background Art

FIG. 1 is a longitudinal sectional view showing a drum-type combination drier and washer in accordance with the conventional art.

The drum-type combination drier and washer in accordance with the conventional art comprises; a tub 21 located in a case 11 for storing washing water; a rotating drum 31 rotatably installed in the tub 21 centering a rotational shaft arranged along a horizontal direction in the tub 21 for washing and drying laundry; and a driving motor 33 located behind the tub 21 for driving the rotating drum 31.

An opening provided with a door 13 is formed in front of the case 11 to put in and take out laundry. The tub 21 is formed as a cylindrical shape to be connected to the opening of the case 11.

A spring member 23 and a damper 25 are respectively installed at upper and lower portions of the tub 21 for supporting the tub 21 in the case 11. A detergent container 30 is provided at an upper portion of the tub 21 to supply detergent. The detergent container 30 is connected to a supplying tube 38 for supplying washing water.

A drain tube 27 is engaged in a lower portion of the tub 21 for draining washing water, and provided with a drain pump 29.

The drum-type combination drier and washer is provided with a drying unit for drying laundry. The drying unit includes; an air circulation duct 32 connected from a rear bottom portion to a frontal portion of the tub 21; a blower 41 and a heater 43 arranged on the air circulation duct 32 for forcibly circulating air and for heating air, respectively; and a condensing water supply tube 37 connected to an entrance of the air circulation duct 32 for supplying condensing water so as to condense water in the air discharged from the tub 21.

The air circulation duct 32 consists of a condensing tube 35 and an air tube 39. The condensing tube 35 has one end connected to a lower portion of the tub 21 and the other end prolonged upwardly in the case 11 and connected to the blower 41. The air tube 39 has one end connected to the blower 41 and the other end connected to a frontal portion of the tub 21.

Herein, the condensing water supply tube 37 is connected to an upper portion of the condensing tube 35.

In the drum-type combination drier and washer in accordance with the conventional art, when a washing process is finished and a drying process starts, the blower 41 is driven, and air in the rotating drum 31 and the tub 21 flows towards the blower 41 through the condensing tube 35.

At this time, if condensing water is supplied in the condensing tube 35 through the condensing water supply tube 37, whereas water in the air is condensed to be introduced at a lower portion of the tub 21, dehumidified air passes the blower 41, flows along the air tube 39 and is heated by the heater 43, thereby circulating in the tub 21 and the rotating drum 31.

Dry air of high temperature introduced in the tub 21 and the rotating drum 31 dries laundry, flows along the condensing tube 35 and the air tube 39 from the tub 21, and repeats the condensing and drying processes, thereby drying laundry.

However, in the drum-type combination drier and washer in accordance with the conventional art, the tub 21 and the air circulation duct 32 have the closed structures so as to prevent air of high temperature from being leaked outward. Accordingly, when a child or a pet is confined in the rotating drum, a suffocation accident can be caused.

Also, in case of that the inside of the tub 21 is communicated with the outside of the case 11, dry air in the tub 21 is exhausted to degrade drying efficiency, and heated air of high temperature is leaked outward to cause accidents such as a burning.

SUMMARY OF THE INVENTION

Therefore, an object of the present invention is to provide a combination drier and washer, and an aeration apparatus thereof, wherein air of high temperature is prevented from being leaked by closing the inside from outside in a drying process, and inside and outside are communicated to aerate when the drying process is finished, thereby not degrading a drying process and reducing accidents.

To achieve these and other advantages and in accordance with the purpose of the present invention, as embodied and broadly described herein, there is provided a combination drier and washer, and an aeration apparatus thereof comprising an air circulation duct connected from one portion of a tub to the other portion for circulating air in the tub; and an aeration means provided in the middle of the air circulation duct for preventing exterior air being introduced in the tub in a drying process, and for aerating exterior air in the tub in an opened state when the drying process is not performed.

The aeration means includes; an aeration tube connected from the air circulation duct to outside of a case for introducing exterior air; and an opening/closing means provided at a spot where the air circulation duct and the aeration tube meet for opening and closing the aeration tube.

The air circulation duct is connected to a condensing water supply tube for supplying condensing water so as to condense water in the air. The opening/closing means is constructed to open and close the aeration tube by condensing water supplied by the condensing water supply tube.

The opening/closing means located at the spot where the aeration tube and the condensing water supply tube meet makes a constant amount of condensing water stay at the time of supplying condensing water. The opening/closing means includes a condensing water stay container for introducing the stayed condensing water into the aeration tube and for closing the aeration tube.

According to one preferred embodiment of the present invention, the condensing water stay container is provided with a bulkhead for containing a constant amount of condensing water and supplying condensing water by way of flowing over the bulkhead. Also, a drain hole is formed at a lower portion of the bulkhead so as to drain the remained condensing water.

The drain hole is formed to drain less amount than that of condensing water supplied by the condensing water supply tube.

According to another preferred embodiment of the present invention, the condensing water stay container includes; a condensing water supply passage at a height where some amount of condensing water stays for supplying the condensing water into the air circulation duct; and a drain hole at a lower portion for draining remained condensing water when condensing water is not supplied.

A lower portion of the aeration tube is arranged at a lower position than the condensing water supply passage.

The drain hole is formed to drain less amount than that of condensing water supplied by the condensing water supply tube.

To achieve these and other advantages and in accordance with the purpose of the present invention, as embodied and broadly described herein, there is provided an aeration apparatus for a combination drier and washer comprising; an air circulation duct provided to circulate and heat air in a tub and dry laundry, and connected from one portion of the tube to the other portion for circulating air in the tub; a condensing water supply tube connected at an upper portion of the air circulation duct for condensing water in circulated air; a condensing water stay container connected between the air circulation duct and the condensing water supply tube for making a constant amount of condensing water stay when condensing water is supplied in the air circulation duct; and an aeration tube connected to the condensing water stay container towards outside of the case and closed by the condensing water in the condensing water stay container for preventing exterior air from being introduced in the tub.

To achieve these and other advantages and in accordance with the purpose of the present invention, as embodied and broadly described herein, there is provided a combination drier and washer that includes an aeration apparatus comprising; a tub located in a case for storing washing water therein; a drum located in the tub for washing and drying laundry; an air circulation duct connected from one portion of the tub to the other portion of the tub for circulating air in the drum; a blower provided in the air circulation duct; a heater provided in the air circulation duct for heating circulating air; and an aeration means provided at the air circulation duct for opening and closing the air circulation duct for preventing exterior air from being introduced into the tub in a drying process, and for aerating exterior air in the tub in an opened state when the drying process is not performed.

The air circulation duct includes; a condensing tube having one end connected to a lower portion of the tub and the other end upwardly prolonged to an upper portion of the tub, thereby being connected to the blower; and an air tube having one end connected to the blower and the other end connected to a frontal portion of the tub and provided with a heater for heating the circulating air.

A condensing water supply tube is formed to condense water in the circulating air at an upper portion of the condensing tube, and the aeration means is opened and closed by condensing water supplied through the condensing water supply tube.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIGS. 3 and 4 are detailed views of FIG. 2, wherein FIG. 3 shows a state in a drying process, and FIG. 4 shows a state when the drying process is finished; and FIGS. 5 and 6 are sectional views showing a combination drier and washer according to another embodiment of the present invention, wherein FIG. 5 shows a state in a drying process, and FIG. 6 shows a state when the drying process is finished.

DETAILED DESCRIPTION OF THE PREFERRED EMBODIMENTS

Reference will now be made in detail to the preferred embodiments of the present invention, examples of which are illustrated in the accompanying drawings.

Figure 1:
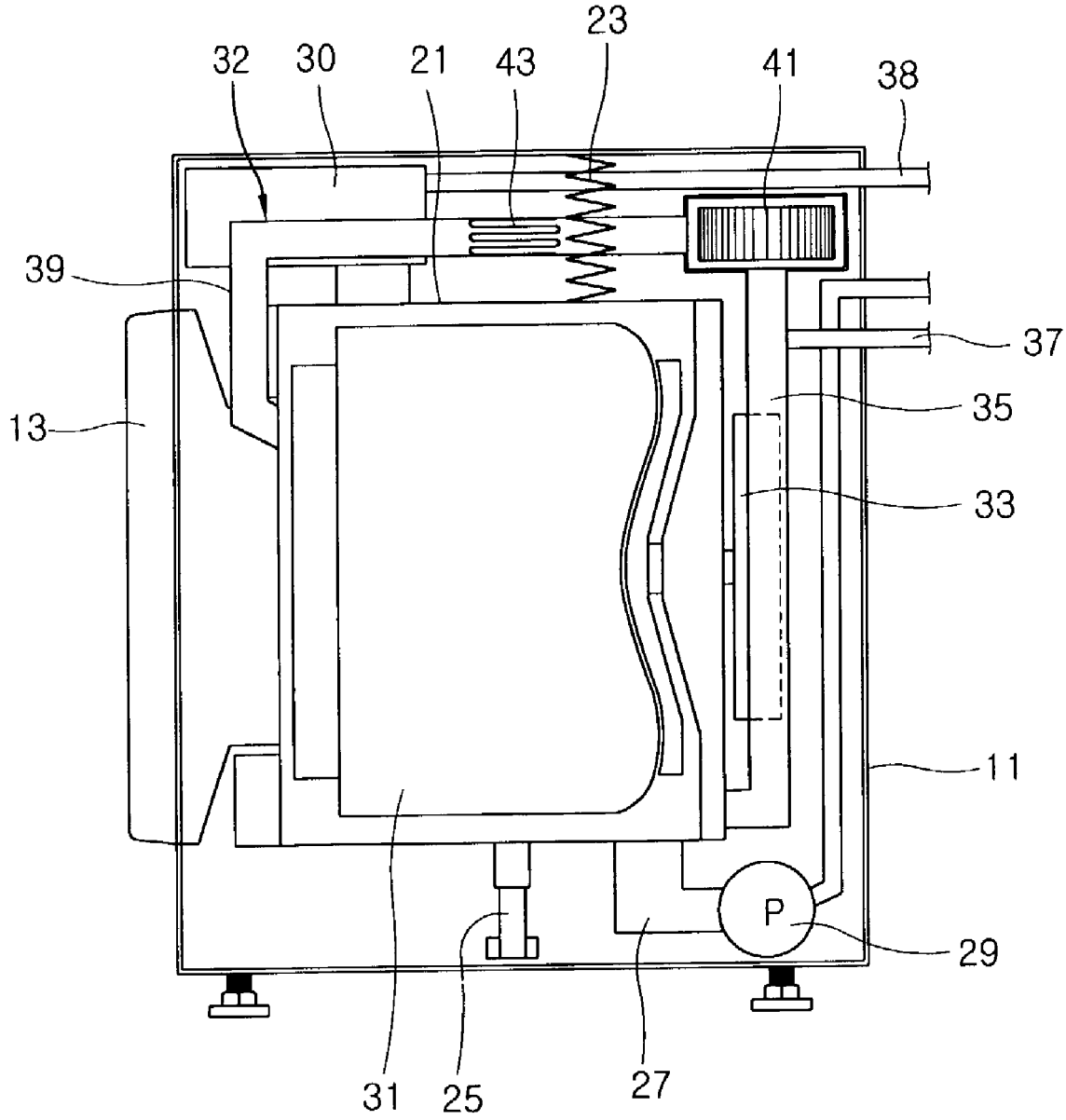
FIG. 1 CONVENTIONAL ART
FIG. 1 is a longitudinal sectional view showing a drum-type combination washer and dried in accordance with the conventional art.
Figure 2:
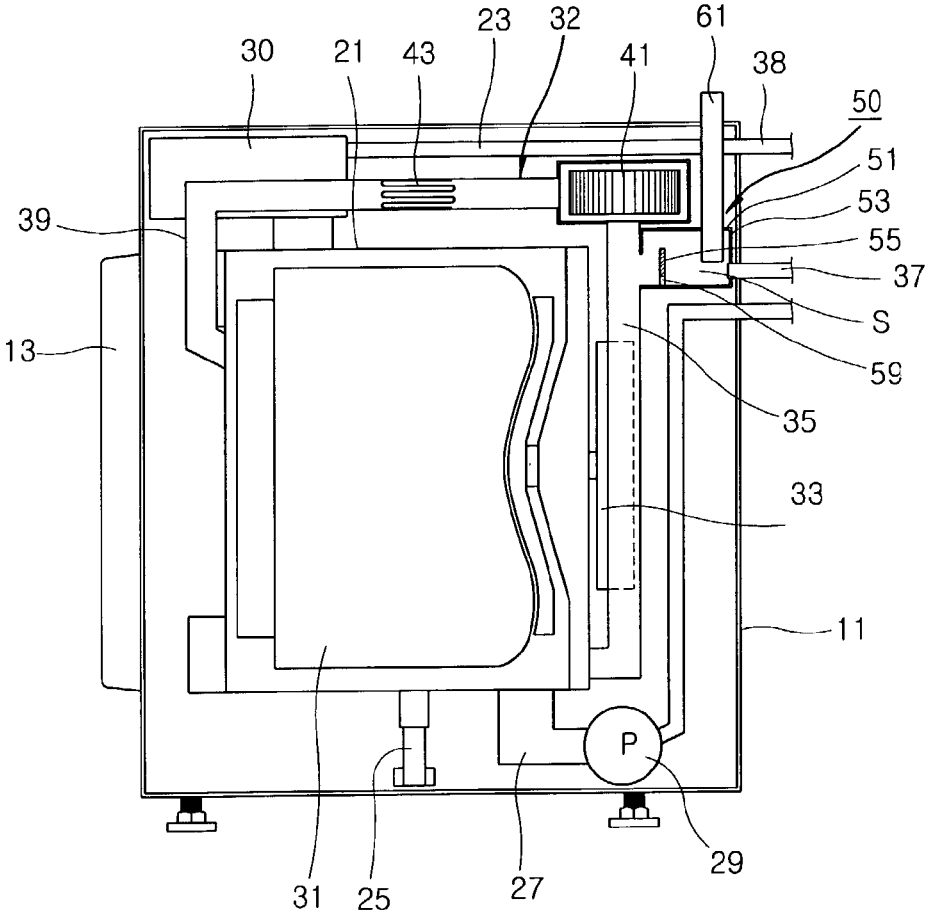
FIG. 2 is a longitudinal sectional view showing a combination drier and washer according to one embodiment of the present invention.

A drum-type combination drier and washer according to one embodiment of the present invention, referring to FIG. 2, comprises a tub 21 located in an case 11 for storing washing water therein; a rotating drum 31 installed to rotate a rotational shaft arranged horizontally in the tub 21 for washing and drying laundry; a driving motor 33 behind the tub 21 for driving the rotating drum 31; a drying unit for circulating air in the rotating drum 31, heating and drying laundry which finishes washing; and an aeration unit 50 connected with the drying unit towards outside of the case 11 for introducing exterior air into the rotating drum 31 by being closed in a drying process and by being opened when the drying process is finished.

The drying unit includes: an air circulation duct 32 connected from a rear bottom portion of the tub 21 to a frontal portion; a blower 41 arranged on the air circulation duct 32 for forcibly circulating air; a heater 43 arranged on the air circulation duct 32 for heating circulating air; and a condensing water supply tube connected to an opening of the air circulation duct 32 for supplying condensing water so as to condense water of air discharged from the tub 21.

The air circulation duct 32 includes a condensing tube 35 having one end connected to a lower portion of the tub 21 and the other end upwardly prolonged in the case 11 and connected to the blower 41; and an air tube 39 having one end connected to the blower 41 and the other end connected to a frontal portion of the tub 21.

Herein, the condensing water supply tube 37 is connected to an upper portion of the condensing water tube 35, and the aeration unit 50 is formed at an interconnected spot between the condensing water supply tube 37 and the condensing water tube 35.

The aeration unit 50 includes: a condensing water stay container 51 located at an interconnected spot between the condensing tube 35 and the condensing water supply tube 37 for containing condensing water therein in a drying process; and an aeration tube 61 having one end exposed to outside of the case 11 and the other end connected to and communicated with the condensing water stay container 51 for introducing condensing water contained in the condensing water stay container 51 in a drying process.

Figure 3:
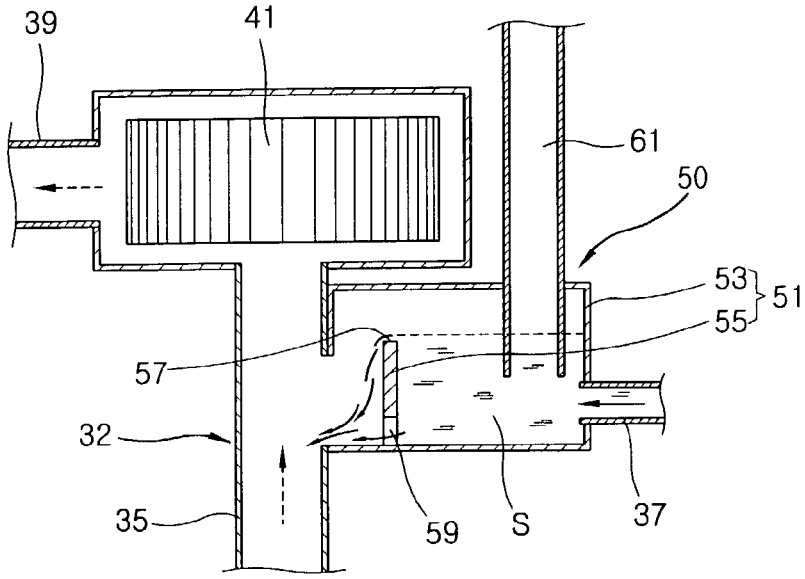

The condensing water stay container 51, referring to FIG. 3, includes: a container portion 53 having open portion connected to and communicated with the condensing tube 35; and a bulkhead portion 55 in the container portion 53 having a predetermined height difference with an upper portion of the container portion 53 so as to form a supply opening 57.

At a bottom of the bulkhead portion 55, a drain hole 59 is formed for discharging the whole condensing water instead of containing the condensing water in the container portion 53 when the drying process is finished. Herein, the drain hole 59 is formed to have a sectional flow area comparatively smaller than the supply opening 57 and the condensing water supply tube 37.

Once a drying process starts and the blower 41 is driven, air discharged from the tub 21 is introduced upwardly in the condensing tube 35, and air via the blower 41 flows along the air tube 39 is heated by the heater 43, and returns to the tub 21.

If a drying process starts, condensing water is supplied from the condensing water supply tube 37 into the condensing water stay container 51, and some of the supplied condensing water is discharged to the condensing tube 35 through the drain hole 59. Since supply amount of the condensing water from the condensing water supply tube 37 is much larger than that discharged to the drain hole 59, condensing water is filled in the condensing water stay space S formed by the bulkhead portion 55.

If the condensing water supplied from the condensing water supply tube 37 fills the condensing water stay space S, additionally-supplied condensing water is discharged to inside of the condensing tube 35 through the supply opening 57 and the drain hole 59 formed at an upper portion of the bulkhead portion 55. Air absorbing water in the tub 21 flows upwardly along the condensing tube 35 containing water via the tub 21 is cooled by condensing water, and water in the air is condensed, introduced into a lower region of the tub 21 with the condensing water, discharged outward through the drain hole 27, thereby making a dry processing.

Figure 4:
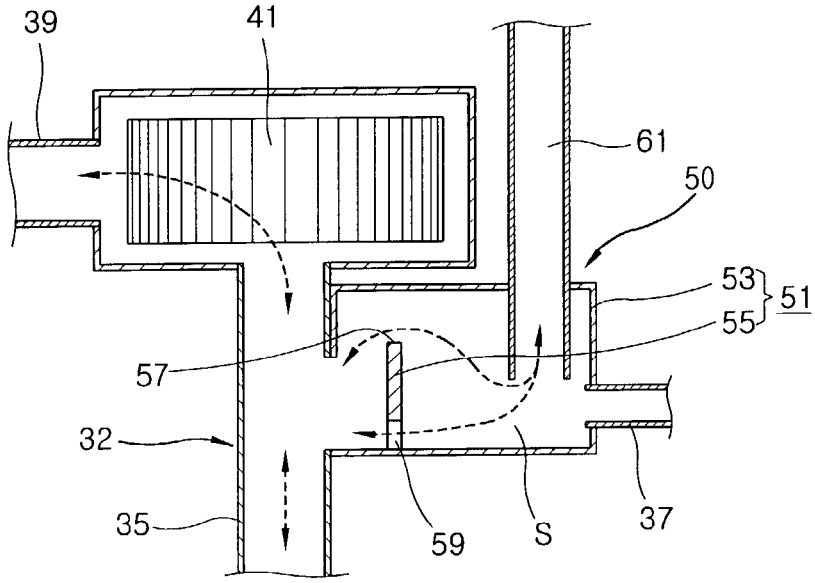

Meanwhile, if the dry processing is finished, as shown in FIG. 4, condensing water is not supplied from the condensing water supplying tube 37 any longer, and the condensing water remaining in the condensing water stay space S is discharged into the condensing tube 35 through the drain hole 59. Also, if the remained condensing water contained in the condensing water stay space S and the aeration tube 61 is all drained, inside of the tub 21 is aerated with exterior air through the aeration tube 61, the condensing tube 35, and the air tube 39.

Figure 5:
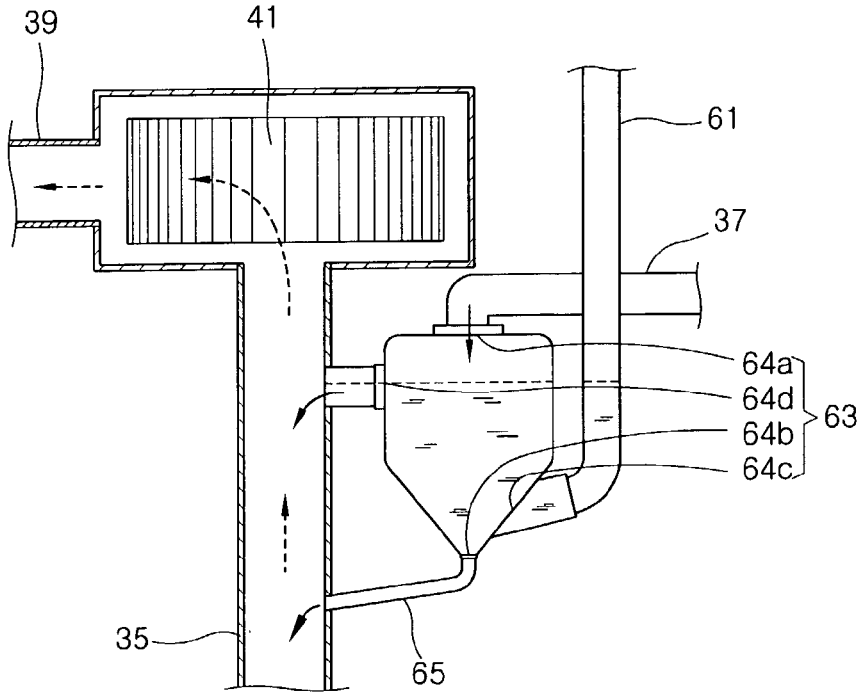
Figure 6:
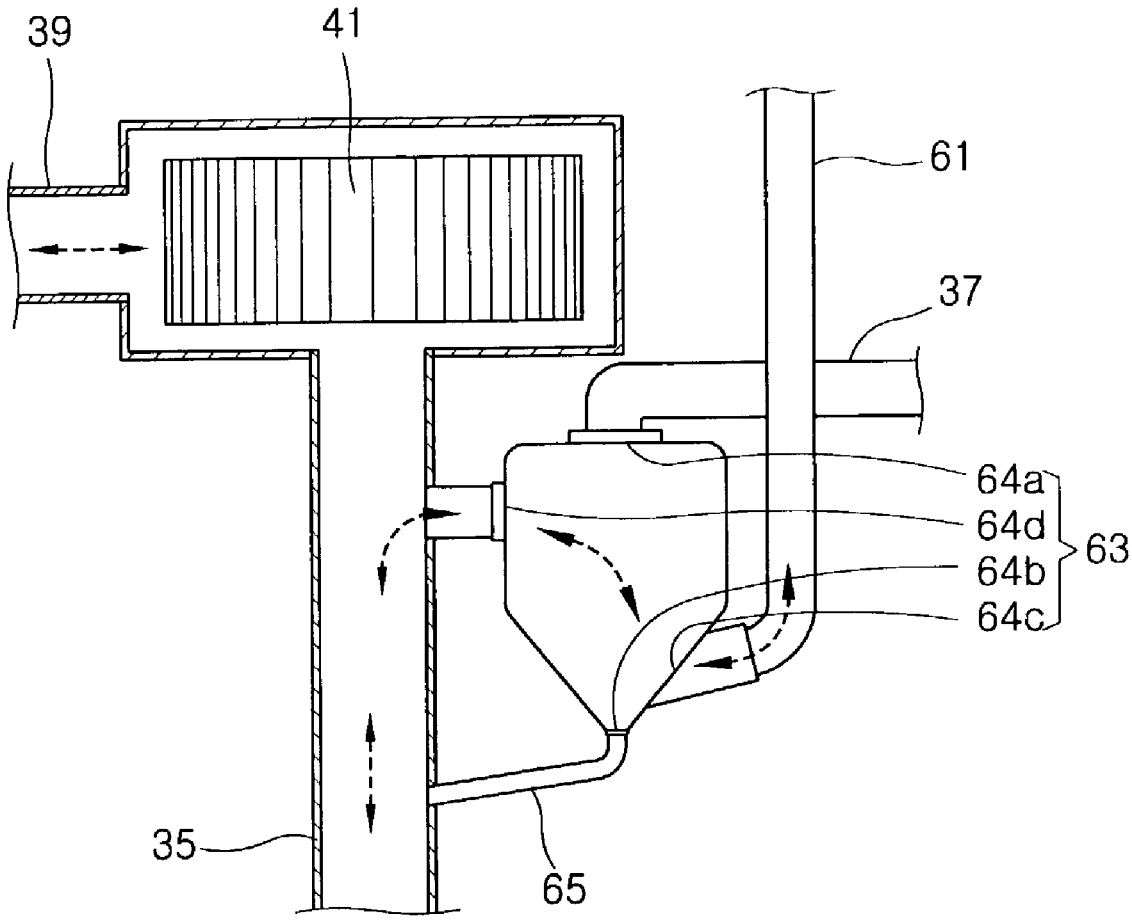

FIGS. 5 and 6 are sectional views illustrating a combination drier and washer according to another embodiment of the present invention, wherein FIG. 5 shows a state in a dry processing, and FIG. 6 shows a state when the dry processing is finished.

The combination drier and washer according to another embodiment of the present invention comprises: a container portion 63 arranged between the condensing water supply tube 37 and the condensing tube 35 and interconnected for containing condensing water therein; and an air tube 61 having one end connected to outside of the case 11 and the other end engaged in the container portion 63 so as to introduce condensing water in a dry processing without aeration from outside and so as to discharge the condensing water and then aerate when the dry processing is finished.

Sectional areas of the lower region of the container portion 63 gradually decreases towards a down direction thereof. Also, a supply opening 64*a* is formed at an upper portion of the container portion 63, and connected with the condensing water supply tube 37. A drain hole 64*b* is formed at a lower portion to discharge condensing water. The drain hole 64*b* is connected to a connecting tube 65 of which one end is connected to inside of the condensing tube 35. An aeration hole 64*c* is formed above the drain hole 64*b* for connecting the aeration tube 61. Also, a supply opening 64*d* is formed above the aeration hole 64*c* with a predetermined height difference so as to discharge condensing water to the condensing tube 35 region.

If a dry processing starts, as shown in FIG. 5, condensing water is supplied from the condensing water supply tube 37 to inside of the container portion 63, and some of the supplied condensing water is discharged into the condensing tube 35 through the drain hole 64*b* and some is introduced into the aeration tube 61, so that aeration is not generated between inside of the tub 21 and outside, thereby preventing air from being leaked.

Condensing water is continuously supplied into the condensing portion 63 and then water level is reached to the supply opening 64*d*, the condensing water is discharged into the condensing tube 35 through the supply opening 64*d*. Then, the condensing water introduced to the condensing tube 35 condenses water in the air and is introduced into a lower region of the tub 21, thereby being discharged outward through the drain tube 27.

In the meantime, if a drying process is finished and condensing water is not supplied any more, as shown in FIG. 6, the whole condensing water introduced in the container portion 63 and the aeration tube 61 is discharged through the drain hole 64*b*. According to this, the aeration tube 61 is opened, and the tub 21 is aerated with exterior air through the aeration tub 61, condensing tube 35, and the aeration tube 39.

As aforementioned, according to the present invention, air of high temperature is not leaked outward in a drying process, and aerated with exterior air when the drying process is finished, thereby preventing a suffocation accident when a child or a pet is confined therein.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An aeration apparatus for a combination drier and washer comprising:

an air circulation duct connected from one portion of a tub to the other portion for circulating air in the tub and provided with a heater for drying laundry;

an aeration tube connected from the air circulation duct to outside of the case for introducing exterior air; and an opening/closing means provided at a spot where the air circulation duct and the aeration tube meets for opening and closing the aeration tube, wherein the air circulation duct is connected to a condensing water supply tube for supplying condensing water so as to condense water in air, and the opening/closing means is constructed to open and close the aeration tube by condensing water supplied by the condensing water supply tube.

2. The apparatus of claim 1, wherein the opening/closing means is located at a spot where the aeration tube and the condensing water supply tube meets, and formed to make a constant amount of condensing water stay at the time of supplying condensing water, thereby including a condensing water stay container for introducing the stayed condensing water in the aeration tube and for closing the aeration tube.

3. The apparatus of claim 2, wherein the condensing water stay container is provided with a bulkhead for containing a constant amount of condensing water by way of flowing over the bulkhead, and a drain hole is formed at a lower portion of the bulkhead so as to drain the remained condensing water.

4. The apparatus of claim 3, wherein the drain hole is formed to drain less amount than that of condensing water supplied by the condensing water supply tube.

5. The apparatus of claim 2, wherein the condensing water stay container includes;

a condensing water supply passage at a height where some amount of condensing water stays for supplying the condensing water into the air circulation duct; and a drain hole at a lower portion for draining remained condensing water when condensing water is not supplied.

6. The apparatus of claim 5, wherein a lower portion of the aeration tube is arranged at a lower position than the condensing water supply passage.

7. The apparatus of claim 6, wherein the drain hole is formed to drain less amount than that of condensing water supplied by the condensing water supply tube.

8. An aeration apparatus for a combination drier and washer comprising:

an air circulation duct provided to circulate and heat air in a tub and dry laundry, and connected from one portion of the tub to the other portion of the tub for circulating air in the tub;

a condensing water supply tube connected at an upper portion of the air circulation duct for condensing water in the circulated air;

a condensing water stay container connected between the air circulation duct and the condensing water supply tube for making a constant amount of condensing water stay when condensing water is supplied in the air circulation duct;

an aeration tube connected to the condensing water stay container towards outside of the case; and an opening/closing means provided at a spot where the condensing water stay container and the aeration tube meet for opening and closing the aeration tube, wherein the condensing water stay container is connected to a condensing water supply tube that supplies condensing water to condense water in the circulated air, and the opening/closing means is constructed to open and close the aeration tube by the condensing water supplied by the condensing water supply tube.

9. The apparatus of claim 8, wherein the condensing water stay container includes;

a condensing water supply passage at a height where some amount of condensing water stays for supplying the condensing water in the air circulation duct; and a drain hole at a lower portion for draining remained condensing water when condensing water is not supplied.

10. The apparatus of claim 9, wherein a lower portion of the aeration tube is arranged at a lower position than the condensing water supply passage.

11. The apparatus of claim 9, wherein the drain hole is formed to drain less amount than that of condensing water supplied by the condensing water supply tube.

12. A combination drier and washer comprising;

a tub located in a case for storing washing water therein;

a drum located in the tub for washing and drying laundry;

an air circulation duct connected from one portion of the tub to the other portion of the tub for circulating air in the drum;

a blower provided on the air circulation duct;

a heater provided in the air circulation duct for heating circulating air;

an aeration tube connected from the air circulation duct to outside of the case for introducing exterior air; and an opening/closing means provided at a spot where the air circulation duct and the aeration tube meets for opening and closing the aeration tube, wherein the air circulation duct is connected to a condensing water supply tube for supplying condensing water so as to condense water in air, and the opening/closing means is constructed to open and close the aeration tube by the condensing water supplied by the condensing water supply tube.

13. The combination drier and washer of claim 12, wherein the air circulation duct includes;

a condensing tube having one end connected to a lower portion of the tub and the other end upwardly prolonged to an upper portion of the tub, thereby being connected to the blower; and an air tube having one end connected to the blower and the other end connected to a frontal portion of the tub and provided with a heater for heating the circulating air;

a condensing water supply tube is formed to condense water in the circulating air at an upper portion of the condensing tube; and the aeration means is opened and closed by condensing water supplied through the condensing water supply tube.

14. The combination drier and washer of claim 12, wherein the opening/closing means is located at a spot where the aeration tube and the condensing water supply tube meets, and formed to make a constant amount of condensing water stay at the time of supplying condensing water, thereby including a condensing water stay container for introducing the stayed condensing water in the aeration tube and for closing the aeration tube.

15. The combination drier and washer of claim 14, wherein the condensing water stay container includes;

a condensing water supply passage at a height where some amount of condensing water stays for supplying the condensing water in the air circulation duct; and a drain hole at a lower portion for draining remained condensing water when condensing water is not supplied.

16. The combination drier and washer of claim 15, wherein a lower portion of the aeration tube is arranged at a lower position than the condensing water supply passage.

* * * * *